United States Patent [19]

Kanno

[11] 4,173,340

[45] Nov. 6, 1979

[54] GAME STRUCTURE HAVING A TETHERED BALL

[75] Inventor: Hideyuki Kanno, Gardena, Calif.

[73] Assignee: Tomy Corporation, Carson, Calif.

[21] Appl. No.: 890,907

[22] Filed: Mar. 28, 1978

[51] Int. Cl.[2] ..... A63B 71/04

[52] U.S. Cl. ..... 273/95 A; 273/58 C

[58] Field of Search ..... 273/26 E, 29 A, 58 C, 273/95 A, 184 B, 185 C, 185 D, 196, 198, 200 R, 200 B

[56] References Cited

U.S. PATENT DOCUMENTS 3,452,990 7/1969 Nichols ..... 273/200 B X

*Primary Examiner*—Anton O. Oechsle

*Attorney, Agent, or Firm*—Edward D. O'Brian

[57] ABSTRACT

A structure useful in playing a game in which a tethered ball is repeatedly being engaged can be constructed so as to utilize a hinged member connecting a tether for the ball to an upright support mounted on a base. The hinge member is preferably constructed as a unitary body out of a resilient, elastomeric material such as a natural or synthetic rubber so as to include ends which are sufficiently large and massive so as to be incapable of bending connected by a flexible portion shaped so as to permit bending between the ends of the hinge member and so as to permit the ends being twisted relative to one another no more than about 90 degrees when the ends are located so as to be in alignment with one another. The flexible portion also permits twisting between the ends of the hinge member when the ends are not located in alignment with one another. This hinge member serves to control movement of both the tether and the ball carried by the tether so as to provide that the ball may be moved in more or less the manner in which a ball is hit back and forth across a net in a conventional net type game such as tennis, Ping Pong or the like.

4 Claims, 4 Drawing Figures

GAME STRUCTURE HAVING A TETHERED BALL

BACKGROUND OF THE INVENTION

The invention set forth in this specification pertains to a new and improved structure which is useful in playing a game in which a tethered ball is repeatedly engaged so as to be hit back and forth in much the manner in which a ball is hit back and forth in a conventional net type game such as tennis, Ping Pong, badminton or the like.

Virtually everyone is familiar with such conventional net type games. The widespread popularity of these games attests that they are of a desirable character. Unfortunately it is impossible to play many of such games in a comparatively small indoor area because of the playing area required with such games. Some of such net type games such as Ping Pong are normally considered to be suitable for use in comparatively small indoor areas because of the size of the playing court or table required. Such games are, however, relatively disadvantageous for indoor use because of the fact that the balls used with them are not tethered and hence are apt to be hit into areas which are inaccessible and/or in such a manner as to cause damage to various objects located in the areas where such games are played.

It is considered that these considerations have resulted in the development of various different games employing a ball tethered by a flexible member such as a rope or elastic cord or the like to an upright support. Such games may be played by the tethered ball being manually engaged so as to move back and forth between different locations. Some of such games are constructed so that the tether for the ball is wound around a support as such a game is played. For many play purposes it is considered more desirable to have a tethered ball type game constructed so that it can be played by several players using paddles or rackets to propel the ball back and forth relative to the support for a tether rather than to wind the tether around the support. It is commonly considered that the use of a racket in engaging a ball and moving it back and forth between areas on different sides of the tether is desirable because of the amount of force which can be applied to a ball through the use of a racket or paddle.

Structures for holding a tethered ball so that such a ball may be hit back and forth between different areas with paddles or rackets have been constructed in various different ways. It is considered that those structures in which a flexible rope like tether is merely connected to the top of an upright support are undesirable because there is the tendency for the tethered ball to engage the support as it is hit back and forth and because there is a tendency for the tethered ball to remain in the area of the support if it is not properly engaged with a paddle or racket.

It has been proposed to remedy this type of problem through the use of an arm pivotally mounted on an upright support so as to carry the tether attached to the ball at a point remote from the upright support. Although this type of structure is considered to be utilitarian it is considered to be somewhat undesirable because of the costs of and problems relating to the reliability of the pivotal connection between the arm and the support. Further, this type of structure does not adequately control the movement of the tethered ball so as to effectively simulate movement of a ball from one side of the net in a conventional net type game to the other.

SUMMARY OF THE INVENTION

As a result of these considerations it is considered that there is a need for a new and improved structure useful in playing a simulated net type game in which a tethered ball is held so that it may be moved back and forth on a tether relative to a support. A broad objective of the present invention is to fulfill this need. Further objectives of the invention are to provide structures of the type noted which are relatively simple, which are relatively inexpensive, which may be utilized over a prolonged period without difficulty and which are satisfactory from a play value standpoint in controlling the motion of a tethered ball as it is moved in more or less the manner in which a ball moves back and forth across the net in a conventional net type ball game.

In accordance with this invention these objectives are achieved by providing a structure useful in playing a game, this structure including a base, a support having an upper end attached to the base so as to extend upwardly from the base, a tether having ends, connecting means connecting the upper end of the support to one end of the tether and a ball secured to the other end of the tether in which the improvement comprises: said tether comprising an elongated rod, said connecting means comprising a hinge member having ends and a flexible portion located intermediate said ends of said hinge member, one of said ends of said hinge member being secured to the upper end of the support so as to be incapable of movement relative to the support, the other of the ends of the hinge member being secured to the first mentioned end of the tether, the flexible portion of the hinge member being shaped so as to permit bending between the ends of the hinge member and so as to permit the ends of the hinge member being twisted relative to one another no more than about 90 degrees when the ends are located so as to be in alignment with one another, the flexible portion permitting twisting between the ends when the ends are not located in alignment with one another.

BRIEF DESCRIPTION OF THE DRAWING

The invention is best more fully described with reference to the accompanying drawing in which.

Figure 1:
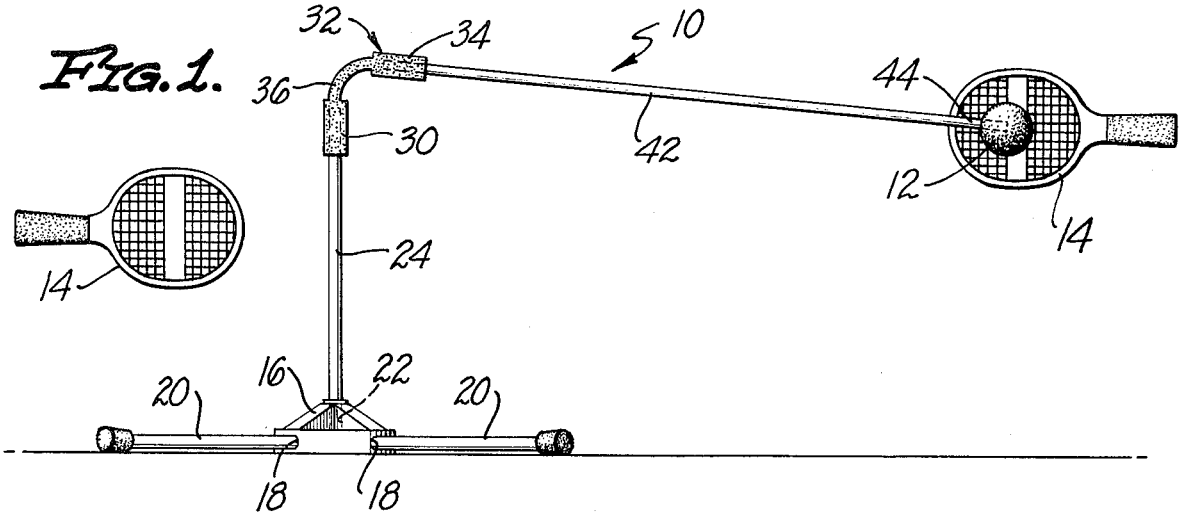
FIG. 1 is a side elevational view of a presently preferred embodiment or form of a structure in accordance with this invention for playing a game using paddles as illustrated.
Figure 2:
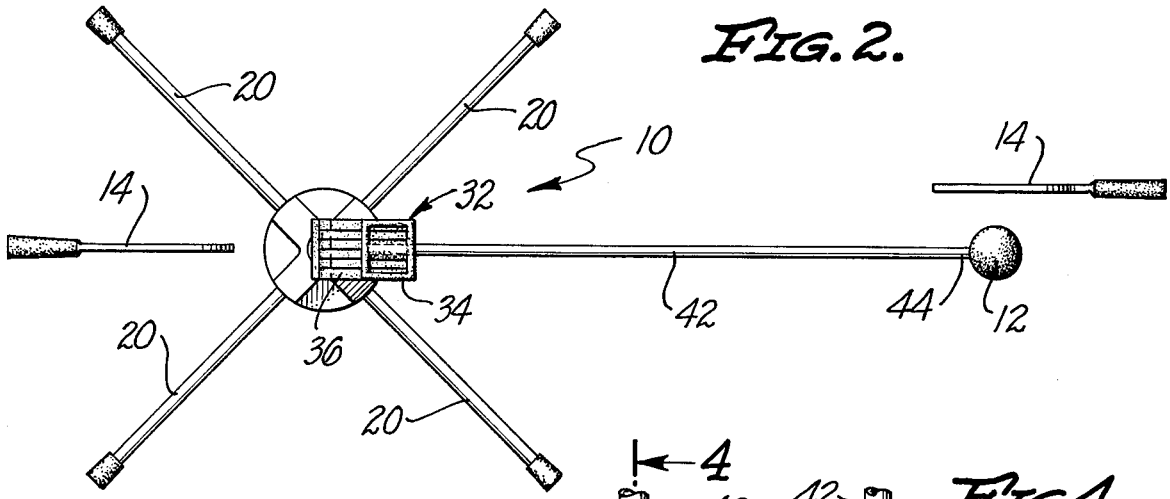
FIG. 2 is a top plan view of the structure shown in FIG. 1 in which the paddles are also illustrated.
Figure 3:
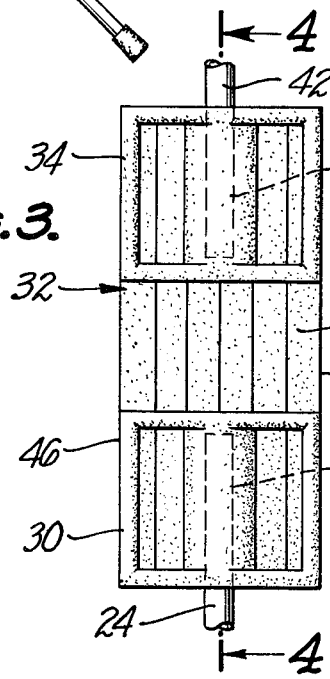
FIG. 3 is a front elevational view of a hinge member employed in the structure shown in the preceding figures in which the hinge member is shown in an unbent, untwisted condition and in which portions of a support and tether interfitting with the hinge member are illustrated.
Figure 4:
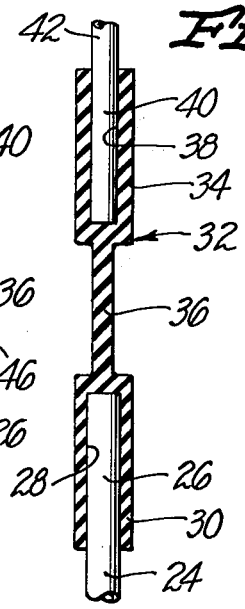
FIG. 4 is a partial cross-sectional view taken at line 4—4 of FIG. 3.

The particular structure illustrated in the accompanying drawing incorporates the principles or concepts set forth in the appended claims. These principles or concepts may be easily used in other somewhat differently appearing and somewhat differently constructed structures through the exercise of routine engineering skill in the toy industry. For this reason the invention is not to be considered limited to the precise structure illustrated.

DETAILED DESCRIPTION

In the drawing there is shown a structure 10 which is useful in playing a game in which a tethered ball 12 is repeatedly engaged by paddles 14 so as to be moved back and forth. Obviously conventional rackets of various types (not shown) may be substituted for the paddles 14. This structure 10 includes a base (not separately numbered) including a conical centrally located member 16. Various holes 18 are provided in this member 16 so that stabilizer rods or legs 20 may be inserted in these holes 18 so as to extend outwardly from the member 16 in order to stabilize the member 16 against movement. The member 16 and the legs 20 are considered to constitute what may be referred to as the complete base (not separately numbered) used with the structure 10.

The member 16 includes a centrally located hole 22 into which an upright support 24 may be inserted. The support 24 fits closely within the hole 22 so as to be secured against movement. This support 24 has an upper end 26 of a non-round, oval cross-sectional configuration which is adapted to fit closely within the interior of a correspondingly shaped hole 28 in an end 30 of a hinge member 32.

This hinge member 32 is preferably formed as a unitary body or article out of a resilient elastomeric material such as a natural or synthetic rubber composition. This hinge member 32 includes another end 34 and a rectilinear flexible portion 36 connecting the ends 30 and 34. The end 34 is provided with a hole 38 which is aligned with the hole 28 in the end 30 when the hinge member 32 is in an unstressed or unbent condition. This hole 38 is adapted to fit closely around the exterior of an end 40 of an elongated tether rod 42 having another end 44 secured to the ball 12. The construction of this hinge member 32 is considered quite important in accordance with this invention.

The ends 30 and 34 are sufficiently massive and large so as to both be substantially incapable of bending or flexing during the utilization of the structure 10. As opposed to this the flexible portion 36 is sufficiently thin so as to be capable of flexing or bending. In addition, however, the length and the width of the flexible portion 36 between the ends 30 and 34 are chosen so as to permit twisting of the flexible portion 36 between these ends 30 and 34.

The amount of such twisting is preferably limited by the physical dimensions of the hinge member 32 so that when the ends 30 and 34 are located with the holes 28 and 38 in alignment with one another the flexible portion 36 can twist no more than about 90 degrees from their normal unstressed position in which the ends 30 and 34 lie in a common plane. This flexible portion 36 will also twist to some degree when the ends 30 and 34 are not located in a common plane as, for example, when the flexible portion 36 is bent in a hinge-like manner. The exact dimensions necessary to accomplish the ability to twist and flex as indicated will depend upon the specific elastomeric material used. The precise shape of the hinge member 32 illustrated is considered preferable in accomplishing the mode of movement described.

From an examination of the drawing it will be noted that the flexible portion 36 appears as a substantially flat, rectilinearly shaped strip of material having ends (not separately numbered) which is sufficiently thin so as to be capable of bending between the ends 30 and 34. From a consideration of the drawing it will be apparent that the distance between the side edges 46 of the flexible portion 36 is greater than the distance along the flexible portion 36 between the ends 30 and 34. Preferably the distance between these side edges 46 should be greater than the distance between the ends 30 and 34 so that the dimensions of the flexible portion 36 serve to limit the amount that said flexible portion may twist. It is noted that the flexible portion 36 is attached to the ends 30 and 34 completely between the side edges 46 so as to further serve to limit the twisting of the flexible portion 36.

The reason why the hinge member 32 is formed in this manner will be apparent from a consideration of the use of the structure 10. During such use the ball 12 will be hit back and forth through the use of the paddles 14. By virtue of the construction of the hinge member 32 described this hinge member 32 will partially control the movement of the ball 12 so that this ball 12 will move between areas (not separately numbered) on opposite sides of the support 24 which approximately correspond to the areas on the opposite sides of the net in a conventional net game such as tennis, Ping Pong or the like. With the structure 10 the hinge member 32 restrains the movement of the ball 12 so that it can only go back and forth between such areas. However, concurrently, the hinge member 32 can twist and flex to a sufficient extent to accommodate movement imparted to the ball 12 through the use of the paddle 14 which reasonably simulates the manner in which the ball moves in a conventional net game.

I claim:

1. A structure useful in playing a game, said structure including a base, a support having an upper end attached to said base so as to extend upwardly from said base, a tether having ends, connecting means connecting said upper end of said support to one end of said tether and a ball secured to the other end of said tether in which the improvement comprises:

said tether comprising an elongated rod, said connecting means comprising a hinge member having ends and a flexible portion located intermediate said ends of said hinge member, one of said ends of said hinge member being secured to said upper end of said support so as to be incapable of movement relative to said support, the other of said ends of said hinge member being secured to the first mentioned end of said tether, said flexible portion of the hinge member being shaped so as to permit bending between said ends of said hinge member and so as to permit said ends being twisted relative to one another no more than about 90 degrees when said ends are located so as to be in alignment with one another, said flexible portion permitting twisting between said ends when said ends are not located in alignment with one another, said flexible portion is a substantially flat, rectilinearly shaped strip of material having ends, said strip being sufficiently thin so as to be capable of bending between said ends and said strip, the distance between the side edges of said strip being no greater than the distance between the ends of said strip so that the dimensions of said strip serve to limit the amount that said flexible portion may twist.

2. A structure as claimed in claim 1 wherein:

said ends of said hinge member are sufficiently large and massive so as to be substantially incapable of bending and are attached to said ends of said flexible portion throughout the lengths of said ends of said flexible portion.

3. A structure as claimed in claim 1 wherein:

said upper end of said support has a non-round configuration, said one of said ends of said hinge member secured to said support includes a non-round hole fitting closely around said upper end of said support.

4. A structure as claimed in claim 1, 2 or 3 wherein:

said hinge member is a unitary body formed of a rubber material.

* * * * *